United States Patent [19]

Mindt

[11] 4,391,692

[45] Jul. 5, 1983

[54] DEVICE FOR THE CHEMICAL OR ELECTROCHEMICAL SURFACE TREATMENT OR MATERIAL IN A HEATED LIQUID TREATMENT MEDIUM, MORE PARTICULARLY A STRIP PICKLING PLANT

[75] Inventor: Walter Mindt, Bendorf, Fed. Rep. of Germany

[73] Assignee: Mannesmann Aktiengesellschaft, Dusseldorf, Fed. Rep. of Germany

[21] Appl. No.: 222,987

[22] Filed: Jan. 7, 1981

[30] Foreign Application Priority Data

Jan. 8, 1980 [DE] Fed. Rep. of Germany ..... 3000408

[51] Int. Cl.[3] ..... C25D 7/06; C25D 17/02

[52] U.S. Cl. ..... 204/206; 204/28; 134/64 R

[58] Field of Search ..... 204/206–211, 204/28; 134/64 R, 64 P, 122 R, 200

[56] References Cited

U.S. PATENT DOCUMENTS

| | | | |
|---|---|---|---|
| 3,399,130 | 8/1968 | Lovekin | 204/206 |
| 3,543,775 | 12/1970 | Bodnar | 134/64 R |
| 3,616,425 | 10/1971 | Klein et al. | 204/206 |
| 3,644,181 | 2/1972 | Donaldson | 204/15 |
| 3,975,242 | 8/1976 | Matsuda et al. | 204/206 X |
| 4,075,076 | 2/1978 | Xylander | 204/206 |

FOREIGN PATENT DOCUMENTS

| | | |
|---|---|---|
| 46-11561 | 3/1971 | Japan . |
| 54-39179 | 11/1979 | Japan . |

*Primary Examiner*—F. Edmundson
*Attorney, Agent, or Firm*—Holman & Stern

[57] ABSTRACT

A device for the chemical or electrochemical surface treatment of material in a heated liquid treatment medium and comprising a liquid tank with a lid, more particularly a strip pickling plant, in which the evaporation surface of the liquid is reduced by at least one cover member immersed in the liquid. The cover member can be mounted on the tank lid or can be placed on supports within the tank.

7 Claims, 3 Drawing Figures

DEVICE FOR THE CHEMICAL OR ELECTROCHEMICAL SURFACE TREATMENT OR MATERIAL IN A HEATED LIQUID TREATMENT MEDIUM, MORE PARTICULARLY A STRIP PICKLING PLANT

BACKGROUND OF THE INVENTION

1. Field of the Invention

The invention relates to apparatus for the chemical or electrochemical surface treatment of material in a heated liquid treatment medium, comprising a liquid tank with a lid, more particularly a strip pickling plant, in which the strip surface can be partially covered to reduce the evaporation surface. The invention therefore relates to all kinds of so-called process lines in which materials such as strip steel, wire or tube is surface treated by treatment media which are heated above room temperature. The surface treatment can comprise pickling, cleaning, coating and the like. The treated material can pass through the treatment medium or can be immersed in the liquid for a specific treatment time.

2. Description of the Prior Art

The problem on which the invention is based is explained in detail hereinbelow by reference to a strip pickling plant for continuously passing strip steel. In strip pickling plants of this kind, having a plurality of pickling tanks disposed in tandem, the liquid surface is situated, depending on the design of the plant, between 1000 and 200 mm above the surface of the continuously passing strip steel. Depending on the throughput rate and the dimensions of the material, these tanks have free evaporating surface areas of between 2 and 400 $m^2$. The total heat requirement of a pickling plant for strip of 1350×2.7 mm at an hourly output rate of 180 metric tons amounts to approximately 21 kJ/h (5 million kcal/h).

Broken down, this heat requirement is approximately divided as follows:

- for heating the material approximately 9.24 kJ/h (2.2 million kcal/h),
- for surface radiation approximately 1.26 kJ/h (300,000 kcal/h),
- evaporation energy from the free surface area of the treatment medium approximately 10.5 kJ/h (2.5 million kcal/h).

Furthermore, the evaporation losses of such plants, i.e. the gas produced thereby, must be discharged from the plant by suitable extraction means and in most cases the extracted gases are corrosive and must be cleaned by a scrubbing plant in accordance with legal regulations before such gases can be discharged to atmosphere via a chimney.

To save evaporation losses it is known to cover the surface of the liquid bath by means of a plurality of floating balls (French patent specification 1 192 877). This kind of covering permits the treated material to be inserted into the liquid and be removed therefrom through the floating balls without obstruction but the percentage reduction of the liquid surface is not an optimum because, owing to their geometry, the balls always allow a certain space between them even if they all adjoin each other closely. Furthermore, owing to turbulence in the liquid, the balls can be agitated and thus provide an additional free evaporation surface.

SUMMARY OF THE INVENTION

It is the object of the invention to optimize covering of the evaporation surface of the liquid and thus to reduce the heat consumption of the evaporation proportionately as far as possible. According to the invention, the problem is solved by at least one displacement or cover member which is immersed in the liquid and whose contour in relation to the horizontal cross-section of the liquid tank leaves open a minimum evaporation surface surrounding the displacement member. It is obvious that the predominant proportion of evaporation losses can be minimized by the reduction of the free evaporation surface obtained by the above described means. Furthermore, the invention also reduces the amount of gas which must be extracted so that the extraction device can be made correspondingly smaller. Accordingly, corrosive vapours can be scrubbed with less cost.

In a strip pickling plant of the kind described hereinbefore, the saving of heat energy amounts to approximately 90% of the proportion of evaporation energy and 45% of the proportion of total thermal energy. The saving in the volume of gases to be extracted amounts to approximately 90%. The action of the treatment medium on the material for treatment can be increased by up to 10%.

Conveniently, the cover member is mounted on the tank lid so that it reaches its immersed operative position when the lid is closed. The displacement member can however also be placed on supports disposed within the tank, for example on electrodes.

To protect the displacement member against being mechanically damaged by a strip or the like which is drawn through the liquid, it is advisable to provide the underside of the said member with replacement ribs. It is advantageous, more particularly in conjunction with such replacement ribs, that the underside of the displacement member extends close to the continuously passing treatment material so that the action of the treatment medium on the treated material is enhanced by the turbulence resulting from the flooding in this case.

BRIEF DESCRIPTION OF THE DRAWINGS

A pickling plant, being one exemplified embodiment of the invention, is illustrated in the accompanying drawing in which.

DESCRIPTION OF THE PREFERRED EMBODIMENTS

Figure 1:
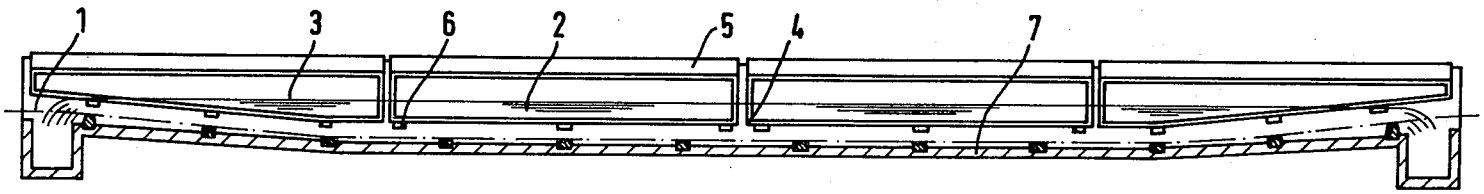
FIG. 1 is a longitudinal section through a pickling tank.

The strip pickling plant illustrated in FIG. 1 is provided for pickling steel strip 1 which is drawn through the pickling tank 7. The pickling tank is filled with an inorganic acid functioning as treatment medium 2, whose evaporating surface 3 is substantially reduced by an immersed cover member 4. The displacement member 4, constructed in U-configuration as a hollow member, is mounted on a tank lid 5 and adapted to the run of the strip, i.e. it has a flat underside. Furthermore, the underside of all displacement members 4 is protected by replacement ribs 6 against being damaged by the strip 1.

Figure 2:
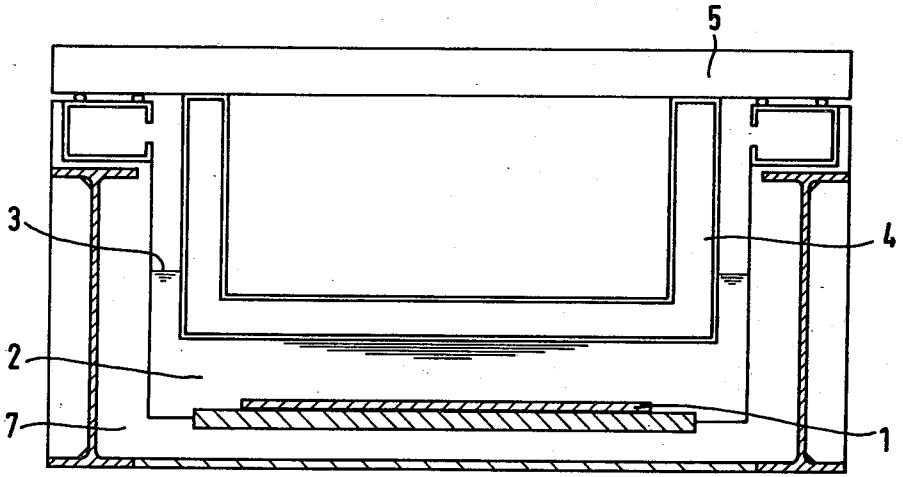
FIG. 2 is a cross-section therethrough.
Figure 3:
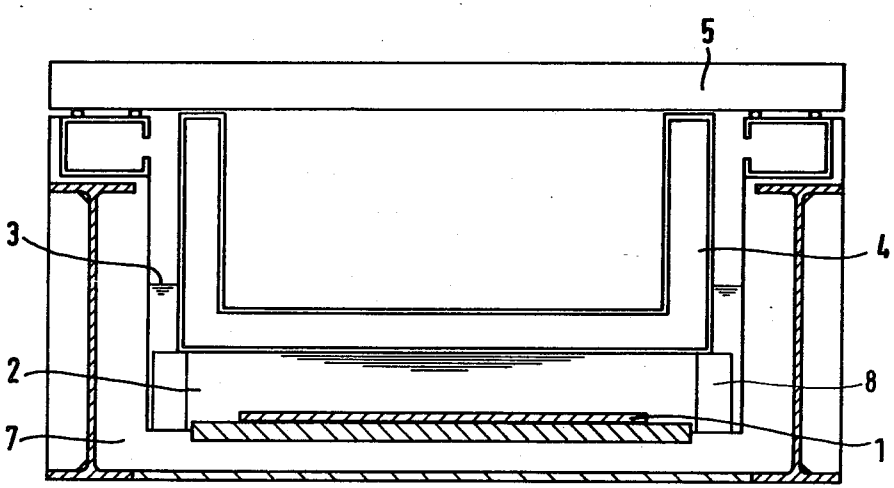
FIG. 3 shows another embodiment of the present invention in cross-section.

FIG. 2 clearly shows that the contour of the displacement member in relation to the horizontal cross-section of the liquid 2 leaves open only a minimal evaporation surface 3, which surrounds the displacement member. If the displacement member 4 is placed upon supports 8 disposed within the tank 7, an alternative embodiment shown in FIG. 3, it is possible for the free evaporation surface to be reduced still further, since mounting of the displacement member on a pivotably supported tank lid calls for a specific amount of open space between the side walls of the displacement member and the tank walls, owing to the co-pivoting arrangement of the displacement member.

What is claimed is:

1. A device for heated liquid treatment of the surface of an object placed therein, comprising:

a tank having an open top portion, said tank capable of receiving an object to be treated and a liquid for such treatment;

a movable lid overlying the opening in said tank;

at least one movable evaporation minimizing cover placed within said tank and attached to said lid, said at least one evaporation minimizing cover being so configured as to be partially immersed in and cover a substantial portion of the surface of a liquid placed in said tank and to displace the liquid so as to reduce free space existing between the surface of the liquid and the underside of said movable lid.

2. A device for heated liquid treatment of the surface of an object placed therein, comprising:

a tank having an open top portion, said tank capable of receiving an object to be treated and a liquid for such treatment;

a movable lid overlying the opening in said tank;

at least one movable evaporation minimizing cover placed within said tank and so configured as to be partially immersed in and cover a substantial portion of the surface of a liquid placed in said tank and to displace the liquid so as to reduce free space existing between the surface of the liquid and the underside of said movable lid; and means for supporting said at least one evaporation minimizing cover within said tank.

3. A device as claimed in claim 2, wherein said lid contacts an upper portion of said at least one evaporation minimizing cover.

4. A device as claimed in claim 1 or claim 2, wherein the underside of said at least one evaporation minimizing cover is provided with replacement ribs.

5. A device as claimed in claim 1 or claim 2, wherein the underside of said at least one evaporation minimizing cover extends close to the object treated in said tank.

6. A device as claimed in claims 1 or 2, wherein said at least one evaporation minimizing cover is configured in a U-shape.

7. A device as claimed in claims 1 or 2, wherein said at least one evaporation minimizing cover is hollow.

* * * * *